United States Patent [19]

Reth et al.

[11] 4,005,594

[45] Feb. 1, 1977

[54] ROLL CHANGING MECHANISM FOR ROLLING MILLS

[75] Inventors: Erich Reth, Duisburg; Hans Gockel, Mulheim (Ruhr), both of Germany

[73] Assignee: Demag Aktiengesellschaft, Duisburg, Germany

[22] Filed: Mar. 3, 1976

[21] Appl. No.: 663,287

[52] U.S. Cl. ..... 72/239

[51] Int. Cl.[2] ..... B21B 31/08

[58] Field of Search ..... 72/239, 238; 29/200 D

[56] References Cited

UNITED STATES PATENTS

| | | | |
|---|---|---|---|
| 3,208,260 | 9/1965 | Sieger et al. | 72/239 |
| 3,323,345 | 6/1967 | Lyle et al. | 72/239 |
| 3,566,498 | 3/1971 | Kato et al. | 72/239 X |
| 3,782,161 | 1/1974 | McGeeney et al. | 72/239 |

*Primary Examiner*—Milton S. Mehr
*Attorney, Agent, or Firm*—Toren, McGeady and Stanger

[57] ABSTRACT

A roll changing mechanism for the rolls of a rolling mill which are mounted in a roll stand and which define therebetween a pass line extending in a given direction includes a roll stand changing cart movable in a direction parallel to the direction of the pass line, a horizontal turntable on the roll stand changing cart having guideways thereon for receiving the roll stand and a swiveling frame adapted to have the roll stand supported therein and mounted for rotation in a vertical plane to move the roll stand through an angle of 90°. The mechanism further includes a first conveyor device extending on one side of the swiveling frame between the roll stand changing cart and the swiveling frame for engaging the roll stand and for moving the roll stand from the changing cart to the swivel frame. A second conveyer device located on the opposite side of the swiveling frame operates to engage insert members of the rolls for removing the rolls from the roll stand when the swiveling frame has been rotated to an appropriate position. Both the first and second conveyor device include a chain drive mechanism and guideways upon which the roll stand or the insert members, respectively, are movable. The roll stand includes pawls on opposite sides thereof enabling engagement by a ratchet mechanism on the first conveyer device for moving the roll stand from the roll stand changing cart to the swiveling frame. After the swiveling frame has been rotated through an angle of 90° with the roll stand mounted therein, a ratchet mechanism on the second conveyor device engages a pawl member on the insert member of the rolls to move the rolls and the insert member along guide ways of the second conveyer device whereby the rolls and the insert member may be moved into or out of the roll stand mounted on the swiveling frame.

8 Claims, 4 Drawing Figures

ROLL CHANGING MECHANISM FOR ROLLING MILLS

BACKGROUND OF THE INVENTION

The present invention relates generally to rolling mills and more particularly to a mechanism for enabling quick change of the rolls of such a mill. The invention is particularly adapted in connection with mills involving vertical rolls in continuous medium and small section mill trains with alternating horizontal and vertical stands which are moved transversely of the direction of the pass line on guide means for changing the rolls.

In continuous medium and small section mill trains it is known to use change units for the roll stands wherein a roll changing cart may be moved parallel to the direction of the pass line and which has arranged thereon guide means for the stands. The stands are pushed transversely of the pass line direction by means of an extension cylinder onto a roll changing cart which is then moved to the side with the complete roll stand being engaged by a crane and transported to a remote turning mechanism. The stand is inserted into the turning mechanism and rotated in a vertical plane through an angle of 90°.

After the stand is received again by the crane, it is transported to a structural support where the hydraulic system is initially disconnected. After lowering the working rolls on extension rails, the rolls with their inserts are pulled out of the stand either with upper and lower insert members or separately, depending upon the size of the stand. In a further operation, a crane is again utilized in order to pull the rolls with the corresponding devices out of the stand.

The repeated engagemet and disengagement by and from the crane, and the operations involving transportation to various structural supports with the crane, is rather complicated particularly in view of the time which is required for changing the stands. This is particularly true when vertical stands are involved since these must be turned first through an angle of 90° before the rolls can be changed because of the special design of the stands.

In view of the aforementioned considerations, the present invention is intended to provide a quick change unit for rolls wherein the disassembly of the vertical rolls may be substantially automated and wherein the need for utilization of a crane may be practically eliminated.

SUMMARY OF THE INVENTION

Briefly, the present invention may be described as a roll changing mechanism for the rolls of a rolling mill, said rolls being mounted in a roll stand and defining therebetween a pass line extending in a given direction, said mechanism comprising a roll stand changing cart which is movable in directions parallel to the direction of the pass line, a horizontal turntable on the changing cart including guide ways thereon for receiving the roll stand, and a swiveling frame adapted to have the roll stand supported therein and being mounted for rotation in a vertical plane through an angle of 90°. First conveyer means extend on one side of the swiveling frame between the roll stand changing cart and the swiveling frame for engaging the roll stand and for moving the roll stand from the changing cart to the swiveling frame. Second conveyer means located on the opposite side of the swivel frame are constructed to include a chain conveyer mechanism having ratchet means for engaging pawls on insert members of the rolls for removing the rolls from the roll stand when the swiveling frame has been rotated to an appropriate position.

The first guide means also include a chain conveyer including ratchet means for engaging pawls on the roll stand in order to move the roll stand from the changing cart to the swiveling frame.

Both the first and second conveyer means include guideways, the guideways of the first conveyer means being adapted to guide the roll stand in its movement and the guideways of the second conveyer means being adapted to guide the insert members as the rolls and the insert members are moved out of the roll stand.

As a result of the configuration of the change unit of the invention, vertical rolls may be changed in a particularly fast advantageous manner especially due to the fact that the necessity for utilizing a crane is practically eliminated. At the same time, the invention enables a considerable reduction in the complexity of the operations which are required thereby enabling roll change in a quick and efficient manner.

By virtue of a special feature of the invention, the turntable of the roll stand changing cart is provided on its underside with a concentric gear rim which meshes with a stationary rack extending in the direction of motion of the changing cart and which is engageable and disengageable with the turntable. As a result, the travel drive of the roll stand change cart may also be used for driving the turntable. When the roll stand changing cart is moved, it is only necessary at the same time to engage or disengage the turntable with the gear rim, as may be required, in order to obtain a rotary motion of the roll stand.

In accordance with a further feature of the invention the swiveling frame is formed to consist of a substantially C-shaped spindleless journaled frame which is equipped to operate as a structural support for the roll stand and which includes means and devices for starting the necessary operations of the stand and which has in one end position guideways which may be aligned with the guideways of the first conveyer means extending between the roll stand changing cart and the swiveling frame for enabling the stand to be received in the swiveling frame. In the other position of the swiveling frame, guideways are provided on the frame for extending and retracting the roll insert members, with these guideways being arranged to adjoin the guideways of the second conveyer means located on the side of the swiveling frame opposite to the side thereof where the roll stand changing cart is located.

The swiveling frame is preferably designed in accordance with the invention as a structural support so that the necessity for transferring the roll stand from the swiveling device to a structural support is eliminated. The roll stand may be introduced directly into the swiveling frame over the first conveyer means and it may be coupled automatically with necessary drives, for example for lowering the screw down mechanisms or with oil couplings.

According to a further feature of the invention, the swivel movement of the swiveling frame is limited to within an angle of 90° by means of stop members arranged on the outer circumference of the C-shaped swiveling frame. The stops insure that the guideways arranged on both sides of the swiveling frame will always be aligned with corresponding guideways of the first conveyer means, for moving the stand from the changing cart to the swiveling frame, and of the second conveyer means, for moving the insert pieces relative to the swiveling frame.

In accordance with a further feature of the invention, there is provided a chain drive mechanism for the swiveling frame which is arranged relative to the outer circumference of the swiveling frame parallel to the plane within which the frame is swiveled. The chain drive mechanism meshes with chain drive wheels on the frame circumference thereby providing a simple and rugged mechanism for driving the spindleless journaled swiveling frame.

The roll stand is provided with disengageable pawls on both sides thereof arranged in the vicinity of the mill floor which are adapted to be engaged with recesses in corresponding ratchets on the first conveyer device associated with the guideways which extend between the roll stand changing cart and the swiveling frame. The first conveyer means is designed as an endlessly revolving chain conveyer and by means of the pawls on the roll stand, the roll stand may be moved into the required positions. If the pawls are not required to be engaged they may be brought at any time into position at which they do not hinder the operation of the rolls or of the changeover mechanism.

In order to move the rolls and their insert members into and out of the swiveling frame, the insert members are provided with pawl means which can be engaged by ratchet means on the second conveyer mechanism associated with guideways which extend from the swivel frame on the side thereof opposite the side on which the roll stand changing cart is located. The pawl means on the insert members can also be moved out of operative position when their use is not required.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive material in which there is illustrated and described a preferred embodiment of the invention.

DETAIL DESCRIPTION OF THE PREFERRED EMBODIMENT

Figures 1, 2, 3, 4:
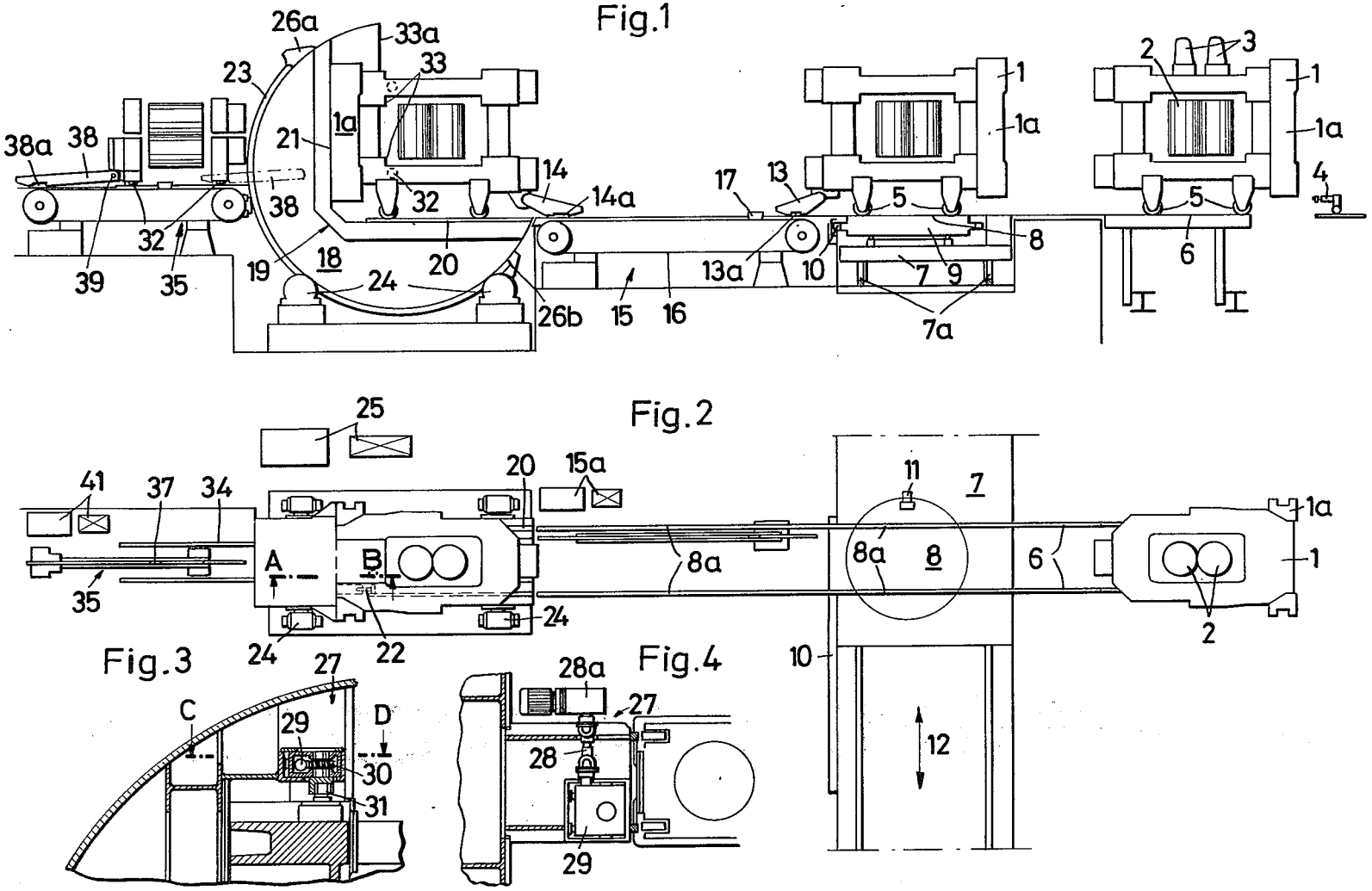
FIG. 1 is a schematic elevation of the quick change unit according to the present invention.
FIG. 2 is a top view of the unit shown in FIG. 1.
FIG. 3 is a partial sectional view taken through the swiveling device of the invention along the line A–B in FIG. 2.
FIG. 4 is a sectional view taken along the line C–D of FIG. 3.

Referring now to the drawings, wherein like reference numerals are used to identify identical parts throughout the various figures thereof, there is shown in FIG. 1 a roll stand 1 having mounted therein vertical rolls 2 defining a pass line which extends between the rolls perpendicular to the plane of the drawing. The stand 1 includes a base plate 1*a* with the vertical rolls 2 being driven through drive means (not shown) by operation of roll journals 3. An extension cylinder 4 operates to move the roll stand 1 out of position relative to the pass line of the rolls. For this purpose, the roll stand 1 is provided with wheels 5 which are arranged for guided movement on rails 6.

The rails 6 are located to extend transversely to the direction of the pass line of the rolls.

A roll stand changing cart 7 is adapted to be moved on rails 7*a* parallel to the direction of the pass line with the rails 7*a* being arranged a sufficient distance below the mill floor that the topside of the cart 7 will be flush with the aforementioned rails 6.

The roll stand changing cart 7 carries on its upper side a turntable 8 which is also provided with rails 8*a* for the wheels 5 of the roll stand 1. Beneath the turntable 8 and on the bottom side thereof there is concentrically arranged a gear rim 9 which may be coupled by means of a locking mechanism 9 is connected to a rack 10 which extends in a direction of motion 12 of the roll stand changing cart.

Arranged on both sides of the roll stand 1 in the range of the mill floor are disengageable pawls 13 and 14 which are provided with recesses 13*a* and 14*a* at their ends spaced from the roll stand 1. On the side of the roll stand changing cart 7 spaced from the mill train and arranged transversely to the mill train there are provided guide rails 8*a* for the wheels 5 of the roll stand 1 which form a part of a first conveyer means including a chain conveyer 15. The chain conveyer 15 consists of an endless revolving chain 16 which is driven by drive means indicated schematically at 15*a*. The chain 16 has on its outer circumference a driver or ratchet 17 which is appropriately dimensioned to enable engagement thereof with the recesses 13*a* and 14*a* of the pawls 13 and 14. At the end of the guide rails 8*a* opposite the roll stand changing cart 7 there is provided a swiveling frame 18 which consists of a substantially C-shaped frame member. In the open side of the C-shaped swiveling frame 18 there is provided a receiving structure 19 for the roll stand 1. The structure 19 is formed of a right-angled configuration, with one leg of the structure 19 being provided with rails 20 upon which the roll stand 1 is carried, the rails 20 being adapted for alignment with the rails 8*a* wherein the swiveling frame 18 is in one of its end positions. The structure 19 includes another leg 21 which serves as a support for the base plate 1*a* of the roll stand 1. The leg 21 of the structure 19 is provided with corresponding couplings and connections for the base plate 1*a* of the stand 1, so that the operations necessary for structural support, such as lowering of inserts, relieving of a hydraulic system, etc. can be properly effectd.

Corresponding drives 27 for the screw-down mechanism are depicted and represented in FIGS. 3 and 4 with an oil coupling 22 being schematically represented and shown in FIG. 2.

The C-shaped swiveling frame has arranged on the outer circumference thereof a chain 23 which is adapted to engage chain wheels 24. The chain wheels 24 are positioned in a coaxial relationship with supporting rolls (not shown) for the C-shaped frame 18. A drive element 25, schematically shown in FIG. 2 operates to drive the chain wheels 24 which will engage the chain 23 thereby effecting the desired rotation or swiveling of the frame 18. As will be noted in FIG. 1, the frame is depicted with the base plate 1*a* of the roll stand extending in a generally vertical position. By operation of the drive means 24, the chain wheels 24 will engage the chain 23 and cause the frame 18 to be rotated counterclockwise through an angle of 90°. The apparatus includes a pair of stop members 26*a* and 26*b* which operate to limit the degree of rotation of the swiveling frame 18. As the frame is swiveled by engagement of the wheels 24 with the chain 23, when the frame 18 moves through an angle of 90° from the position depicted in FIG. 1, the stop members 26*a* and 26*b* will limit the movement of the frame and stop the frame with the base plate 1*a* of the roll stand 1 in a generally horizontal position.

With the frame in this position, removal of the rolls 2 from the roll stand 1 may be effected.

The roll assembly includes insert members 40 having thereon wheels 32 which are adapted to move for guided rolling motion on rails 33 located within the roll stand 1. As previously mentioned, a transmission with drive means is provided at the base of the stand 1 by means of which the insert members of the vertical rolls 2 can be lowered onto extension rails provided in the stand. The drive consists substantially of a spindle 28 which is driven by a motor 28*a* and which operates to drive a worm 29. The worm 29 meshes with a worm wheel 30 from where the journal 21 of the screw-down mechanism is driven.

The rails 33 in the roll stand 1 are arranged to extend in alignment with extension rails 33*a* located in the swiveling device 18. As previously discussed, the swiveling device is moved from a first position depicted in FIG. 1 to a second position whereby the fram 18 is rotated through an angle of 90° with the leg 21 shown vertically in FIG. 1 moved into a generally horizontal position. With the swiveling frame 18 in this second position, the rails 33 will become aligned with rails 34 which are formed as part of a second conveyer means including a chain conveyer 35. The second conveyer means including the chain conveyer 35 is similar to the first conveyer means which includes the chain conveyer 15, and has at its outer end a driver or ratchet 37 which may be brought into engagement through a recess 38*a* with a pawl 38 which is secured at 39 upon an insert member 40 of the vertical rolls 2. When the chain conveyer 35 is driven, by means of the drive device 41 represented schematically in FIG. 2, the vertical rolls 2 together with their insert members may be moved out of the roll stand 1 with the pawl 38 engaged by the ratchet 37 and with wheels 32 rolling in guided engagement upon the rails 34 of the second conveyer means.

From the foregoing it will be seen that the device of the present invention may be operated to change the rolls of a rolling mill, and when rolls must be changed, the operation initially involves moving the roll stand 1 out of the range of the pass line by means of an extension cylinder 4. This operation is performed after the roll journals have been disengaged from their drive means (not shown). The roll stand 1 will be moved transversely of the direction of the pass line by rolling engagement of the wheels 5 on the rail 6. The extension cylinder 4 will push the stand 1 onto the roll stand changing cart 7 and the stand 1 will be stopped on the rails 8*a* of the turntable 8. The extension cylinder 4 may then be retracted.

The turntable 8 is then locked, either manually or automatically, with the gear rim 9 arranged concentrically therebeneath and the roll stand changing cart will be displaced in a direction parallel to the direction of the pass line.

The gear rim 9 operates to engage the rack 10 so that the turntable 8 will be caused to rotate. As soon as the roll stand 1 has been turned through an angle of 180° with the turntable 8, the locking engagement between the turntable and the gear rim 9 is released at 11 and the cart is returned to its starting position in which the guideways 6 and the guideways 8*a* will be aligned.

Pawl 13 and 14 located on both sides of the roll stand 1 are lowered, with the pawl 13 first engaging the driver or ratchet 17 of the chain conveyer 15 of the first conveyer means. The roll stand 1 will be pulled along with the driven chain of the first conveyer means from the turntable to the rails 8*a*, or in a direction to the left as viewed in the drawing of FIG. 1. At the end of the chain conveyer 15, the ratchet 17 turns downwardly and the pawl 13 is released. At this point in the operation of the apparatus, the stand 1 is so far advanced that the pawl 14 arranged at the rear end of the stand will become engaged by a rising ratchet 17 as a result of the continuous rotation of the endless chain conveyer 15 and the engagement between the ratchet 17 and the pawl 14 will cause the roll stand 1 to be pushed thereby in the same direction of motion. As a result, the roll stand will be moved into the swiveling frame 18 to be supported therein in the position shown in FIG. 1.

During the time that the roll stand 1 is moved into supported position upon the frame 18, the swiveling frame 18 is in its first position with the rails 20 aligned with the rails 8*a* so that the stand 1*a* can be moved along the rails 20 and 8*a* into position upon frame 18. The roll stand 1 is moved with its base plate 1*a* directed toward the leg 21 of the receiving structure 19 and at the same time the conveyer 15 is disconnected by means of a limit switch. By operation of a similar switch, or by manual operation, the drive 27 is now lowered, the screw-down mechanism of the vertical rolls 2 is now lowered and the rolls are lowered with wheels 32 on the rails 33 in the stand. The oil pressure system of the stand is relieved over the oil coupling 22 which is simultaneously engaged. Drive 25, which drives the gear wheels 24, is likewise automatically or manually engaged. The gear wheels 24 will engage the chain 23 which is arranged stationary on the swiveling frame 18 and there will thus be effected swiveling of the swiveling frame 18 within a vertical plane.

As previously mentioned, the swiveling motion of the frame 18 will be limited by stop members 26*a* and 26*b* to an angle of 90°. After this rotation has been accomplished, the swiveling frame 18 will be in its second position at which the rail 33 upon which the insert members 40 rest with the wheels 32 are aligned with the rails 34 located on the side of the swiveling device remote from the mill train.

The swiveling device is provided with extension rails 33*a* which bridge the distance between the rails 33 provided in the stand 1 and the rails 34 of the second conveyer means. As soon as the swivel movement of the swiveling frame 18 is completed, the pawl 18 of the insert member 40 will become engaged with the recess 38*a* of the ratchet 37 of the chain conveyer 35. The chain conveyer 35 will be driven by the motor-transmission units 41 and will pull the vertical rolls 2 with the insert members 40 out of the roll stand 1 by engagement with the pawl 38. The disassembled vertical rolls may now be removed by means, for example, of a crane.

The assembly of the vertical rolls 2 is effected by utilizing the exact reverse of the procedures previously described herein. Thus, merely by reversing the operation of the apparatus, assembly of the rolls 2 may be achieved and the preparation of the roll stand 1 may be effected again in the swiveling device 18 which is designed as a structural support.

While a specific embodiment of the invention has been shown and described in detail to illustrate the application of the inventive principles, it will be understood that the invention may be embodied otherwise without departing from such principles.

What is claimed is:

1. A roll changing mechanism for a rolling mill having rolls mounted in a roll stand and defining therebetween a pass line extending in a given direction, said mechanism comprising a roll stand changing cart movable in directions parallel to the direction of said pass line, a horizontal turntable on said changing cart having guideways thereon for receiving said roll stand, a swiveling frame adapted to have said roll stand supported therein, said swiveling frame being mounted for rotation in a vertical plane, first conveyer means extending on one side of said swiveling frame between said roll stand changing cart and said swiveling frame for engaging said roll stand and for moving said roll stand from said changing cart into said swiveling frame, said conveyer means including guideways for guiding said roll stand therebetween, and second conveyer means located on the opposite side of said swiveling frame and including guideways, said rolls including insert members enabling said rolls to be removed from said roll stand and to be moved along said guideways of said second conveyer means, said second conveyer means including means for engaging said insert members and for extending and retracting said insert members and said rolls from said roll stand along said guideways of said second conveyer means.

2. Apparatus according to claim 1 including a concentric gear rim located beneath said turntable and adapted to be engaged and disengaged therewith for rotating said turntable and a stationary rack in engagement with said turntable extending in the direction of motion of said roll stand changing cart.

3. Apparatus according to claim 1 wherein said swiveling frame consists essentially of a substantially C-shaped spindleless journaled frame configured to comprise a structural support for said roll stand, said swiveling frame being equipped with means for effecting necessary roll stand operations, said frame being movable between a first position and a second position, first frame guideways on said frame adapted to receive thereon said roll stand and to become aligned with said guideways of said first conveyer means when said frame is in said first position, second frame guideways on said frame adapted to be aligned with said guideways of said second conveyer means when said frame is in said second position for enabling said roll insert members to be moved out of and into said roll frame.

4. A mechanism according to claim 1 including stop means for limiting rotation of said swiveling frame to within an angle of about 90°.

5. A mechanism according to claim 4 wherein said swiveling frame includes a generally circularly shaped outer circumference and wherein said stop means are arranged to engage said frame along said outer circumference.

6. A mechanism according to claim 5 including driven chain wheels located on the outer circumference of said swiveling frame and chain drive means extending generally parallel to said vertical plane within which said swiveling frame rotates and engaging said chain wheels to drive said frame.

7. A mechanism according to claim 1 wherein said first conveyer means comprise a revolving endless chain conveyer having ratchet means thereon and wherein said roll stand is equipped with pawl means on opposite sides thereof for engagement and disengagement with said ratchet means.

8. A mechanism according to claim 1 wherein said second conveyer means comprise a revolving endless chain conveyer having ratchet means thereon and wherein said insert member is equipped with pawl means for engaging and disengaging said ratchet means in order to effect movement of said insert member into and out of said swiveling frame by operation of said endless chain conveyer.

* * * * *